US010138695B2

(12) United States Patent
Roche et al.

(10) Patent No.: US 10,138,695 B2
(45) Date of Patent: Nov. 27, 2018

(54) DOWNHOLE FLUID FLOW DIVERTING

(71) Applicant: Halliburton Energy Services, Inc., Houston, TX (US)

(72) Inventors: Olivier Christophe Roche, Schaerbeek (BE); Stein Erik Moi, Hommersak (NO)

(73) Assignee: Halliburton Energy Services, Inc., Houston, TX (US)

( * ) Notice: Subject to any disclaimer, the term of this patent is extended or adjusted under 35 U.S.C. 154(b) by 85 days.

(21) Appl. No.: 15/318,133

(22) PCT Filed: Jun. 30, 2014

(86) PCT No.: PCT/US2014/044911
§ 371 (c)(1),
(2) Date: Dec. 12, 2016

(87) PCT Pub. No.: WO2016/003422
PCT Pub. Date: Jan. 7, 2016

(65) Prior Publication Data

US 2017/0130544 A1 May 11, 2017

(51) Int. Cl.

| | |
|---|---|
| ***E21B 34/10*** | (2006.01) |
| ***E21B 21/10*** | (2006.01) |
| ***E21B 23/00*** | (2006.01) |

(52) U.S. Cl.
CPC ..... *E21B 21/103* (2013.01); *E21B 23/006* (2013.01); *E21B 34/10* (2013.01)

(58) Field of Classification Search
CPC ... E21B 2034/007; E21B 34/10; E21B 21/103
See application file for complete search history.

(56) References Cited

U.S. PATENT DOCUMENTS

| | | | |
|---|---|---|---|
| 3,592,275 | A | 7/1971 | Fletcher et al. |
| 5,890,540 | A | 4/1999 | Pia et al. |
| 6,263,969 | B1 | 7/2001 | Stoesz et al. |
| 6,390,200 | B1 | 5/2002 | Allamon et al. |
| 6,467,546 | B2 | 10/2002 | Allamon et al. |
| 7,387,176 | B2 | 6/2008 | Mellott |
| 7,644,766 | B2 | 1/2010 | Begley et al. |
| 7,726,418 | B2 | 6/2010 | Ayling |
| 8,167,051 | B2 | 5/2012 | Eddison et al. |
| 2006/0254822 | A1 | 11/2006 | Ayling |

(Continued)

FOREIGN PATENT DOCUMENTS

| | | | |
|---|---|---|---|
| EP | 1081330 | A2 | 3/2001 |
| GB | 2432380 | A | 5/2007 |
| WO | 2016003422 | A1 | 1/2016 |

*Primary Examiner* — Cathleen R Hutchins
(74) *Attorney, Agent, or Firm* — Alan Bryson; Parker Justiss, P.C.

(57) ABSTRACT

A flow-diverter assembly includes a housing having a discharge port, a valve piston located in the housing, and a barrel cam coupled to the valve piston. The valve piston includes a valve body in fluid communication with an internal flow passage of the housing, and is movable axially along a longitudinal axis of the housing between an open position, where a vent of the valve body is fluidly coupled to the discharge port, and a closed position, where the vent of the valve body is substantially sealed from the discharge port.

16 Claims, 6 Drawing Sheets

(56) References Cited

U.S. PATENT DOCUMENTS

| | | | | |
|---|---|---|---|---|
| 2010/0171058 | A1* | 7/2010 | Jennings | E21B 33/0355 251/251 |
| 2011/0284233 | A1 | 11/2011 | Wu et al. | |
| 2012/0018172 | A1 | 1/2012 | Javed | |
| 2012/0199363 | A1 | 8/2012 | Hu | |
| 2013/0000923 | A1 | 1/2013 | Lee | |
| 2013/0062124 | A1 | 3/2013 | Roders et al. | |
| 2013/0087344 | A1 | 4/2013 | Reid et al. | |
| 2013/0269951 | A1 | 10/2013 | Tahoun et al. | |
| 2014/0020955 | A1 | 1/2014 | Cramer et al. | |

* cited by examiner

DOWNHOLE FLUID FLOW DIVERTING

CROSS-REFERENCE TO RELATED APPLICATION

This application is the National Stage of, and therefore claims the benefit of, International Application No. PCT/US2014/044911 filed on Jun. 30, 2014, entitled "DOWNHOLE FLUID FLOW DIVERTING," which was published in English under International Publication No. WO 2016/003422 on Jan. 7, 2016. The above application is commonly assigned with this National Stage application and is incorporated herein by reference in its entirety.

TECHNICAL FIELD

The present disclosure relates to systems, assemblies, and methods for selectively diverting fluid flow in a downhole drilling environment.

BACKGROUND

In connection with the recovery of hydrocarbons from the earth, wellbores are generally drilled using a variety of different methods and equipment. According to one common method, a roller cone bit or fixed cutter bit is rotated against the subsurface formation to form the well bore. The rotating bit is suspended in the well bore by a tubular drill string. Drilling fluid is pumped through the drill string and discharged at or near the drill bit to assist in drilling operations. In some systems, the flow of drilling fluid through the drill string is altered by diverting a portion of the main flow and discharging the diverted portion from the drill string.

DETAILED DESCRIPTION

Figure 1:
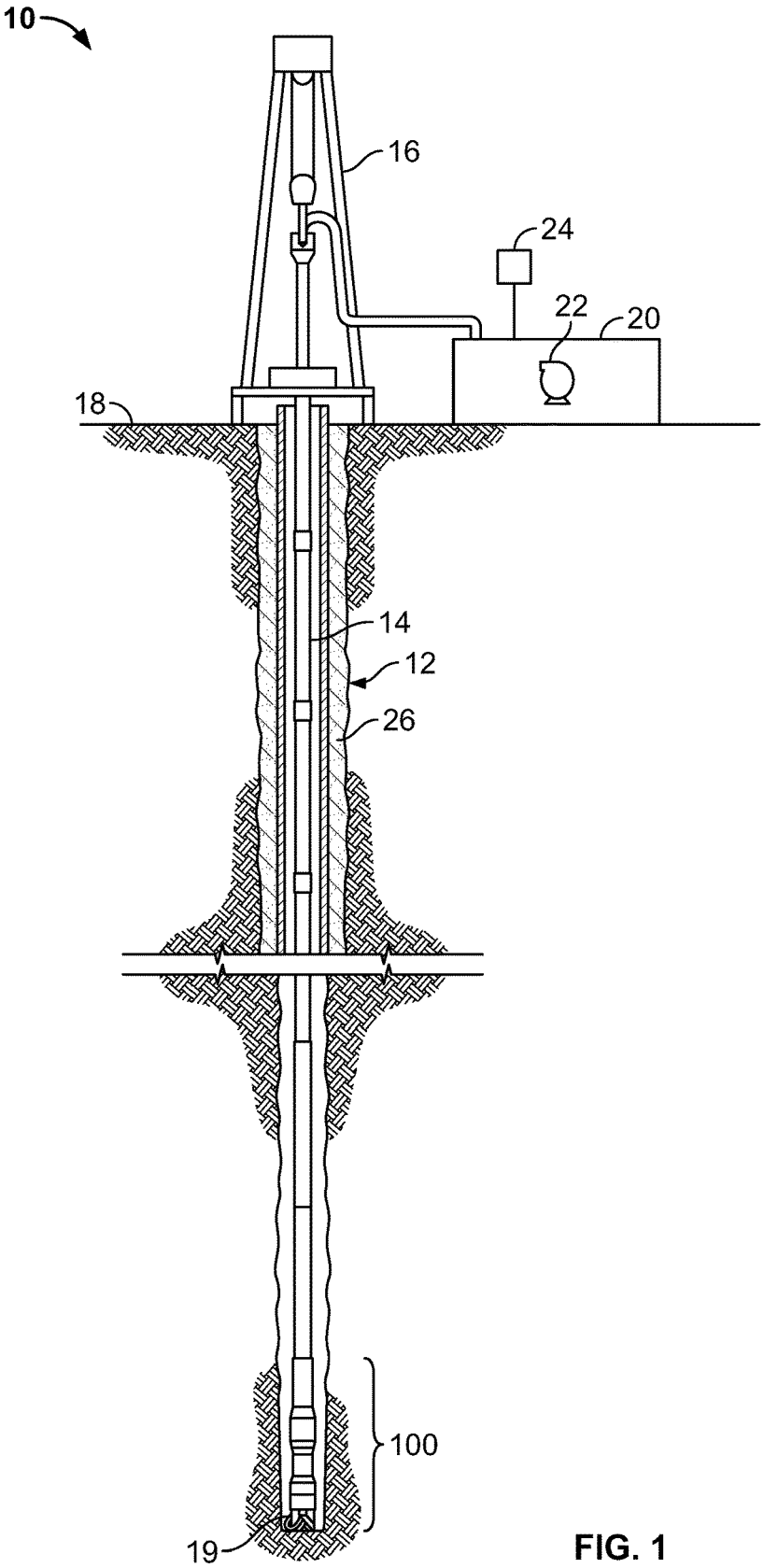
FIG. 1 is a schematic illustration of a drilling rig including a bottom hole assembly equipped with a flow-diverter assembly.

FIG. 1 is a diagram of an example drilling rig 10 for drilling a wellbore 12. The drilling rig 10 includes a drill string 14 supported by a derrick 16 positioned generally on an earth surface 18. The drill string 14 extends from the derrick 16 into the wellbore 12. A bottom hole assembly 100 at the lower end portion of the drill string 14 includes a drill bit 19 and various other tools uphole of the drill bit to facilitate drilling operations (not shown). The drill bit 19 can be a fixed cutter bit, a roller cone bit, or any other type of bit suitable for drilling a wellbore. The drill bit 19 can be rotated by surface equipment that rotates the entire drill string 14 and/or by a subsurface motor (often called a "mud motor") supported in the drill string.

A drilling fluid supply system 20 includes one or more mud pumps 22 (e.g., duplex, triplex, or hex pumps) to forcibly flow drilling fluid (often called "drilling mud") down through a flow passage of the drill string 14 (e.g., a central bore of the drill string). The drilling fluid supply system 20 may also include various other components for monitoring, conditioning, and storing drilling fluid. A controller 24 operates the fluid supply system 20 by issuing operational control signals to various components of the system. For example, the controller 24 may dictate operation of the mud pumps 22 by issuing operational control signals that establish the speed, flow rate, and/or pressure of the mud pumps 22.

The controller 24 is a computer system including a memory unit that holds data and instructions for processing by a processor. The processor receives program instructions and sensory feedback data from memory unit, executes logical operations called for by the program instructions, and generates command signals for operating the fluid supply system 20. An input/output unit transmits the command signals to the components of the fluid supply system and receives sensory feedback from various sensors distributed throughout the drilling rig 10. Data corresponding to the sensory feedback is stored in the memory unit for retrieval by the processor. In some examples, the controller 24 operates the fluid supply system 20 automatically (or semi-automatically) based on programmed control routines applied to feedback data from the sensors throughout the drilling rig. In some examples, the controller operates the fluid supply system 20 based on commands issued manually by a user.

The drilling fluid is discharged from the drill string 14 through or near the drill bit 19 to assist in the drilling operations (e.g., by lubricating and/or cooling the drill bit), and subsequently routed back toward the surface 18 through an annulus 26 formed between the wellbore 12 and the drill string 14. The re-routed drilling fluid flowing through the annulus 26 carries cuttings from the bottom of the wellbore 12 toward the surface 18. At the surface, the cuttings can be removed from the drilling fluid and the drilling fluid can be returned to the fluid supply system 20 for further use.

In the foregoing description of the drilling rig 10, various items of equipment, such as pipes, valves, fasteners, fittings, etc., may have been omitted to simplify the description. However, those skilled in the art will realize that such conventional equipment can be employed as desired. Those skilled in the art will further appreciate that various components described are recited as illustrative for contextual purposes and do not limit the scope of this disclosure. Further, while the drilling rig 10, is shown in an arrangement that facilitates straight downhole drilling, it will be appreciated that directional drilling arrangements are also contemplated and therefore are within the scope of the present disclosure.

Figure 2A:
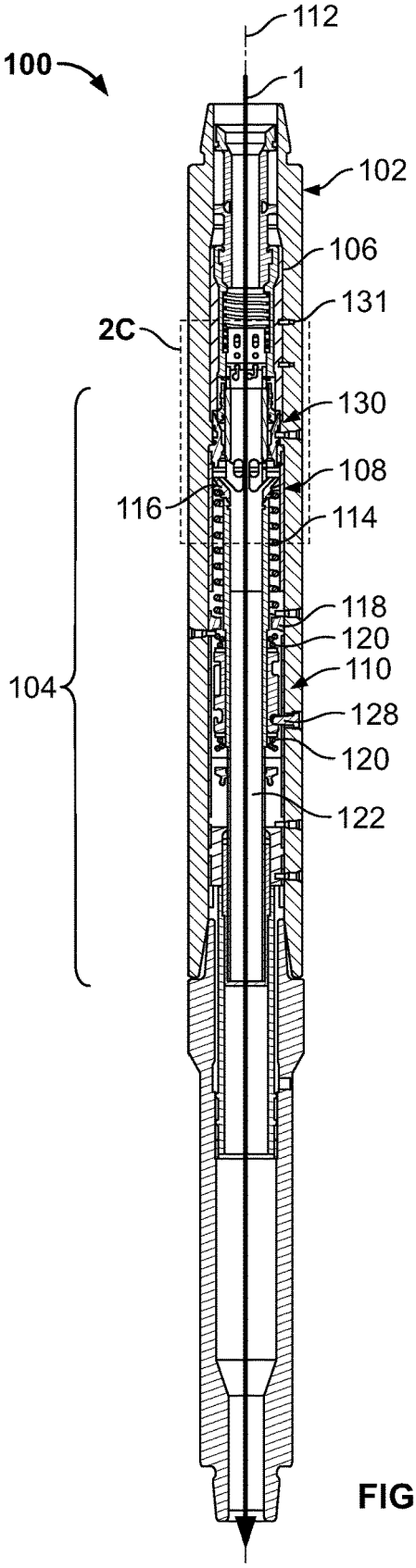
FIG. 2A is a cross-sectional side view of a bottom hole assembly featuring a first flow-diverter assembly in a closed position.
Figure 2B:
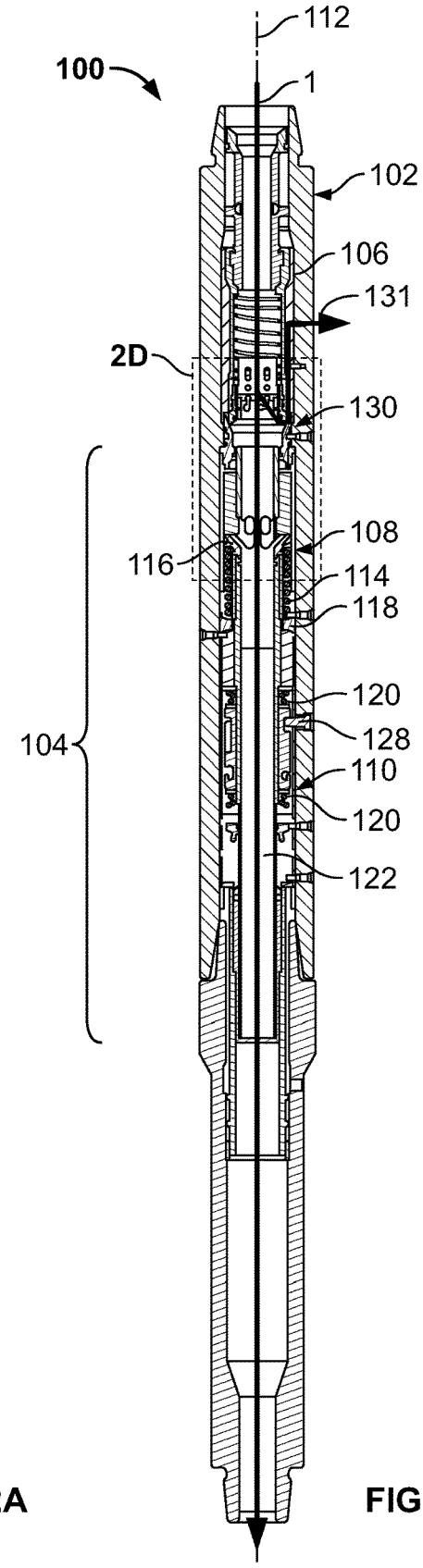
FIG. 2B is a cross-sectional side view of a bottom hole assembly featuring a first flow-diverter assembly in an open position.

FIGS. 2A and 2B are cross-sectional side views of a first example bottom hole assembly 100 that can, for example, be incorporated in the drilling rig 10 depicted in FIG. 1. As shown, the bottom hole assembly 100 includes an elongated housing 102 supporting various components of a first flow-diverter assembly 104 in its central passageway or bore 106. The flow-diverter assembly 104 features a valve piston 108 and a barrel cam 110 arranged coaxially along a longitudinal axis 112 of the housing 102. As will be further described below, the valve piston 108 is coupled to a valve body 130 and actuates the valve body 130 to selectively discharge fluid as the valve piston 108 moves axially through the bore 106. The barrel cam 110 is a rotatable member coupled to the valve piston 108. The barrel cam 110 has a circumferentially arranged track path engaged with a cam follower to control movement of the valve piston 108. Each of the valve piston 108 and the barrel cam 110 has a central flow passage, so as to allow fluid 1 flowing through the housing's bore 106 to pass substantially unimpeded through the flow-diverter assembly 104. This non-restrictive design of various components of the flow-diverter assembly 104 also allows drop balls and other objects to pass substantially unimpeded through the flow-diverter assembly.

The valve piston 108 is movable axially between an upper position (shown in FIG. 2A) and lower position (shown in FIG. 2B) along the longitudinal axis 112. This movement is further detailed and described with reference to FIGS. 2C and 2D. A biasing member 114 is situated axially between a radial shoulder 116 of the valve piston 108 and a stationary flange 118 mounted to the housing 102. Thus, the biasing member 114 urges the valve piston 108 towards the upper position in the housing 102 with a predetermined spring force. Although depicted in this example as a coil spring coaxially arranged with respect to the housing 102, the present disclosure is not so limited. Other suitable types of springs (e.g., disc springs) and elastic members can serve as biasing members without departing from the scope of the present disclosure.

The valve piston 108 moves in response to pressure variations in the housing's bore 106. In particular, a pressure difference between the housing's bore 106 and the annulus 26 provides a net hydraulic pressure force bearing downward on the radial shoulder 116 of the valve piston 108. Accordingly, the valve piston 108 includes a series of radial openings 117 to expose the upper side of the shoulder 116 to drilling fluid (see FIGS. 2C and 2D). The distal edge of the radial shoulder 116 sealingly engages the surrounding wall of the housing 102 to prevent drilling fluid from entering the space on the underside of the shoulder 116 where the biasing member 114 is supported. Pressure variations in the bore 106 of the housing 102 may be caused by changes in the flow rate and pressure of the drilling fluid (changes in the flow rate and pressure can be effected by operation of the mud pumps 22 by controller 24). However, the present disclosure is not so limited. Any suitable method of increasing or decreasing the bore-pressure can be employed without departing from the scope of the present disclosure. For example, a drop-ball method could be used to control the bore-pressure.

An increase in pressure caused by an increased flow rate (e.g., when the mud pumps 22 are activated) builds a hydraulic force that overcomes the upward spring force of the biasing member 114 and pushes the valve piston 108 in a downward direction. Conversely, a decrease in pressure caused by a decreased flow rate (e.g., when the mud pumps 22 are deactivated) weakens the hydraulic force, which allows the biasing member 114 to push the valve piston 108 back towards the upper position.

Figure 3A:
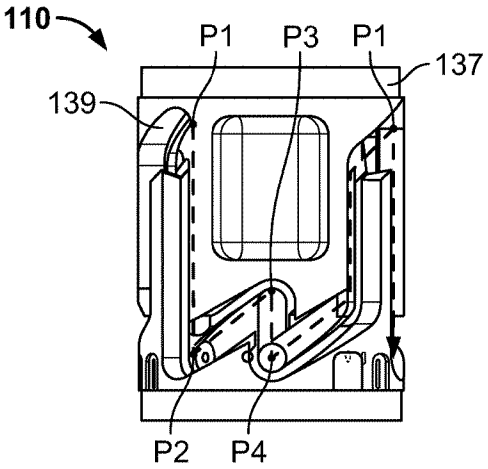
FIG. 3A is a side view of a barrel cam of the first flow-diverter assembly.

The barrel cam 110, further discussed below in conjunction with FIG. 3A, is located in the housing 102 below the valve piston 108. Opposing thrust bearings 120 support the barrel cam 110 for rotation along the housing's longitudinal axis 112. The barrel cam 110 is linked to the valve piston 108 by an elongated coupler 122 extending between the two components. The linkage between the valve piston 108 and the barrel cam 110 allows the valve piston 108 to drive the barrel cam 110 axially in response to pressure variations in the fluid. The barrel cam 110 remains detached from the valve piston 108 with respect to angular movement. That is, the barrel cam 110 is mounted to move axially with the valve piston 108, and to move angularly (i.e., rotation) independent of the valve piston 108. As discussed below with reference to FIGS. 3A and 3B, the barrel cam 110 is engaged in a cam-follower interaction with a stationary pin 128 projecting radially inward from the inner wall of the housing 102 to constrain axial movement of the valve piston 108 at certain points along the track path.

The valve piston 108 actuates a valve body 130 adjustable between an open condition and a closed condition as the valve piston 108 moves. In particular, the valve body 130 is designed to assume an open condition when the valve piston 108 is in the lower position (see FIG. 2B), and a closed condition when the valve piston 108 is in the upper position (see FIG. 2A). An example structure of the valve body 130 is described in detail below. With the valve body 130 in the open condition a portion of the fluid flow 1 through the bore 106 of the housing 102 is diverted through the opened valve body 130 and exits from the housing 102 through a discharge port 131 connecting the housing's bore 106 to a flow path outside of the housing 102 (e.g., the annulus 26 of the wellbore 12). With the valve body 130 in the closed position, fluid discharge is prevented and the fluid flow 1 through the bore remains whole and proceeds through the bore 106.

Figure 2C:
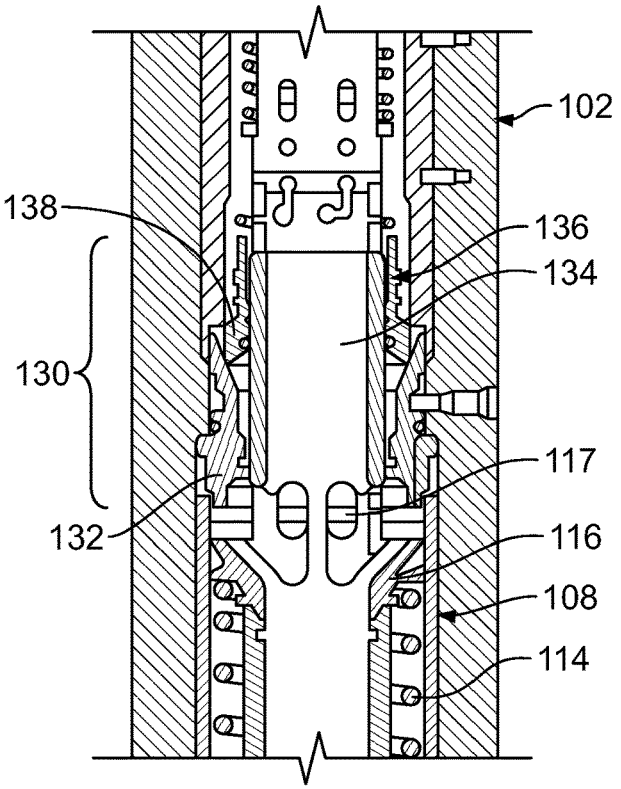
FIG. 2C is an enlarged view of the area marked 2C-2C in FIG. 2A.
Figure 2D:
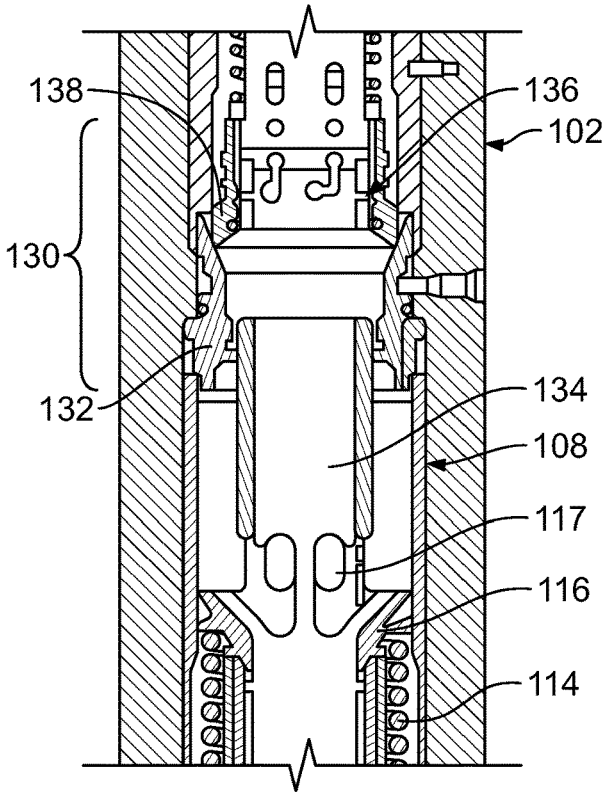
FIG. 2D is an enlarged view of the area marked 2D-2D in FIG. 2B.

Referring to FIGS. 2C and 2D, in this example, the valve body 130 includes a sealing member 132 cooperating with a valve plug 134 formed integrally with the valve piston 108, above the radial shoulder 116. As shown, the sealing member 132 is a cylindrical structure mounted in a fixed position proximate an upper portion of the housing's bore 106. A central bore of the sealing member 132 is sized to receive the valve plug 134, such that the valve plug 134 translates through the bore of the sealing member 132 as the valve piston 108 moves between the upper and lower positions. The sealing member 132 includes a sealing feature 136 designed to cooperate with the valve plug 134. As shown in FIG. 2C, when the valve piston 108 is in the upper position of FIG. 2A, the valve plug 134 engages the sealing feature 136 to prevent fluid from flowing through an annular vent 138. As shown in FIG. 2D, when the valve piston 108 is in the lower position of FIG. 2B, the valve plug 134 is disengaged from the sealing feature 136, which allows fluid to escape through the annular vent 138 towards the discharge port 131.

FIG. 3A is a partial side view of the barrel cam 110. Referring to FIG. 3A and FIG. 2A, the barrel cam 110 is a rotatable member having a circumferentially arranged track path for a cam follower, such as the stationary pin 128, to follow. In this example, the outer surface 137 of the barrel cam 110 includes a slot 139 for receiving the stationary pin 128. The slot 139 creates a track path for the stationary pin 128 to traverse as the valve piston 108 axially drives the barrel cam 110. As shown, the track path of slot 139 is an endless (repeating) pattern. The following description addresses four particular positions (P1-P4) occupied by the stationary pin 128 as the pin 128 traverses the track path. However, the present disclosure is not limited to the example discussed herein. That is, the system can be operated according to various other sequences that will be readily apparent to those of skill in the art.

With the stationary pin 128 at position P1, the valve body 130 is in an open condition because the valve piston 108 is in the lower position. To reach position Pl, the valve piston 108, together with the barrel cam 110, is moved downward by hydraulic force into the lower position due to high pressure in the housing's bore 106 caused by operating the mud pumps 22 at a high flow setting. At this point, the mud pumps 22 are deactivated (or merely adjusted to an appropriately lower flow setting), which causes a pressure decrease in the bore of the housing 102. The decrease in hydraulic pressure force allows the biasing member 114 to "pull" the valve piston 108 towards the upper position, which moves the barrel cam 110 upwards relative to the stationary pin 128. This upward movement of the barrel cam 110 results in the stationary pin 128 moving to a lower position on the track path from position P1 to position P2. The axially upward movement of the barrel cam 110 from position P1 to position P2 represents a movement of the valve piston 108 from the lower position to the upper position—a full stroke of the valve piston 108. Thus, at position P2, the upper position of the valve piston 108, the valve body 130 is in a closed condition.

When the mud pumps 22 are reactivated to restore the high flow condition, the valve piston 108 is pushed downward. As the valve piston 108 bears on the barrel cam 110, the stationary pin 128 traverses the upward angled path of the slot 139 from position P2 to P3. Interaction between the pin 128 and the angled slot path causes a slight rotation of the barrel cam 110, and provides a dead-end to prevent further downward movement of the barrel cam 110, and therefore the valve piston 108. Thus, the valve piston 108 is prevented from traversing a full axial stroke from the upper position to the lower position. In this situation, the valve piston 108 is not moved downward enough to open the valve body 130; so the valve body 130 remains in the closed condition. When the mud pumps 22 are again deactivated, the barrel cam 110 is pulled upward (by result of the biasing member 114 pulling on the valve piston 108 and barrel cam 110 as discussed above) relative to the stationary pin 128, until the pin 128 arrives at position P4. The valve body 130 remains in the closed condition as the valve piston 108 is moved back to the upper position. When the mud pumps 22 are once again reactivated, the barrel cam 110 is pushed downward until the pin arrives at position P1. The axial movement from P4 to P1 allows the valve piston to execute a full stroke from the upper position to the lower position, adjusting the valve body 130 to the open condition. From position Pl, the cycle can be repeated.

Figure 3B:
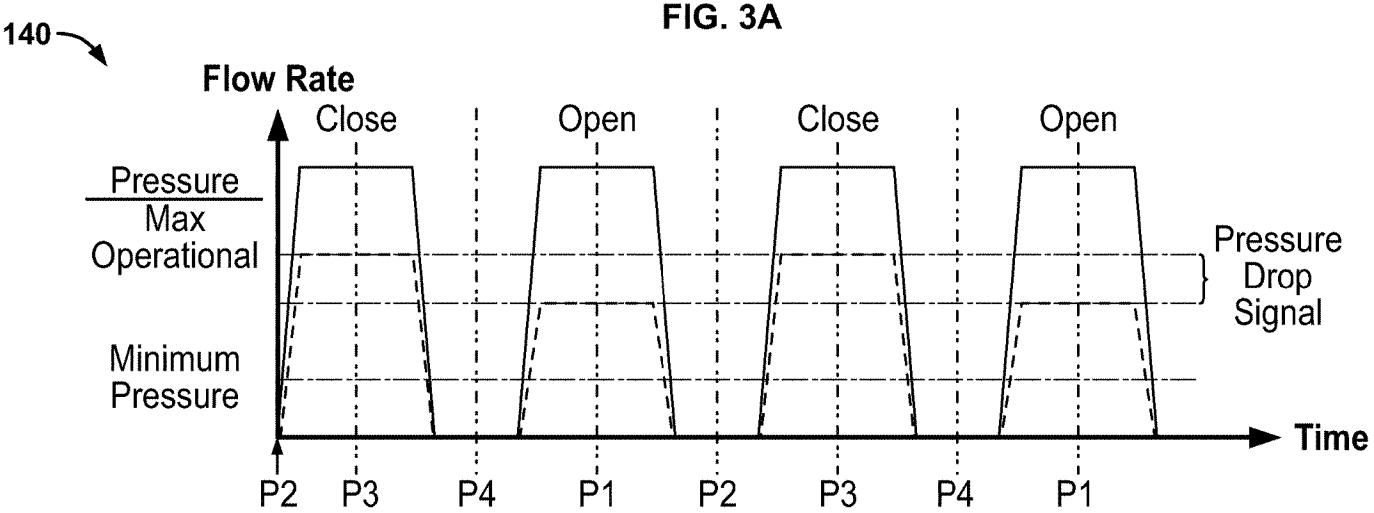
FIG. 3B is a graph illustrating a protocol for operating the first flow-diverter assembly.

FIG. 3B is a graph 140 illustrating a command protocol implemented by the controller 24 to operate the flow-diverter assembly 104 as described above with reference to FIG. 3A. In particular, the graph 140 illustrates how the controller 24 can cycle the mud pumps 22 from ON to OFF or from OFF to ON to change the condition of the valve body 130. In one aspect, the graph 140 illustrates how the high flow rate created by activating the mud pumps 22 creates a pressure in the bore 106 of the housing 102 that is greater than a minimum pressure required to overcome the spring force of the biasing member 114. When the valve body 130 is open, the pressure caused by the high flow rate is less than the high-flow-rate pressure when the valve body 130 is closed. In some examples, the controller 24 monitors this pressure drop signal to determine whether the valve body 130 is in the open condition or the closed condition.

Figure 4A:
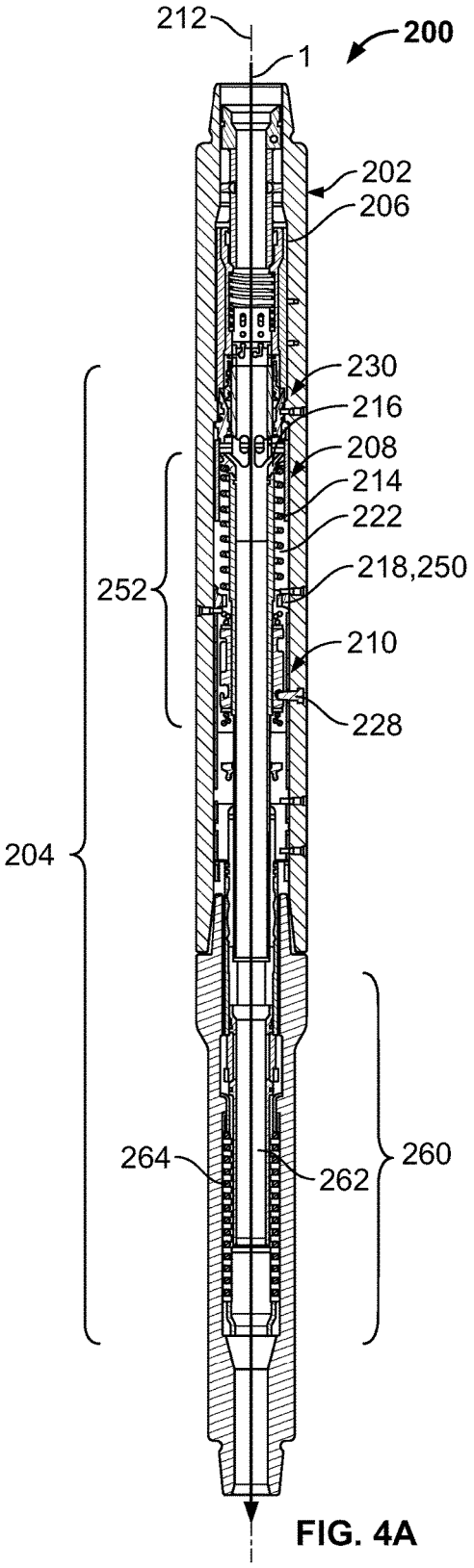
FIG. 4A is a cross-sectional side view of a bottom hole assembly featuring a second flow-diverter assembly in a closed position.
Figure 4B:
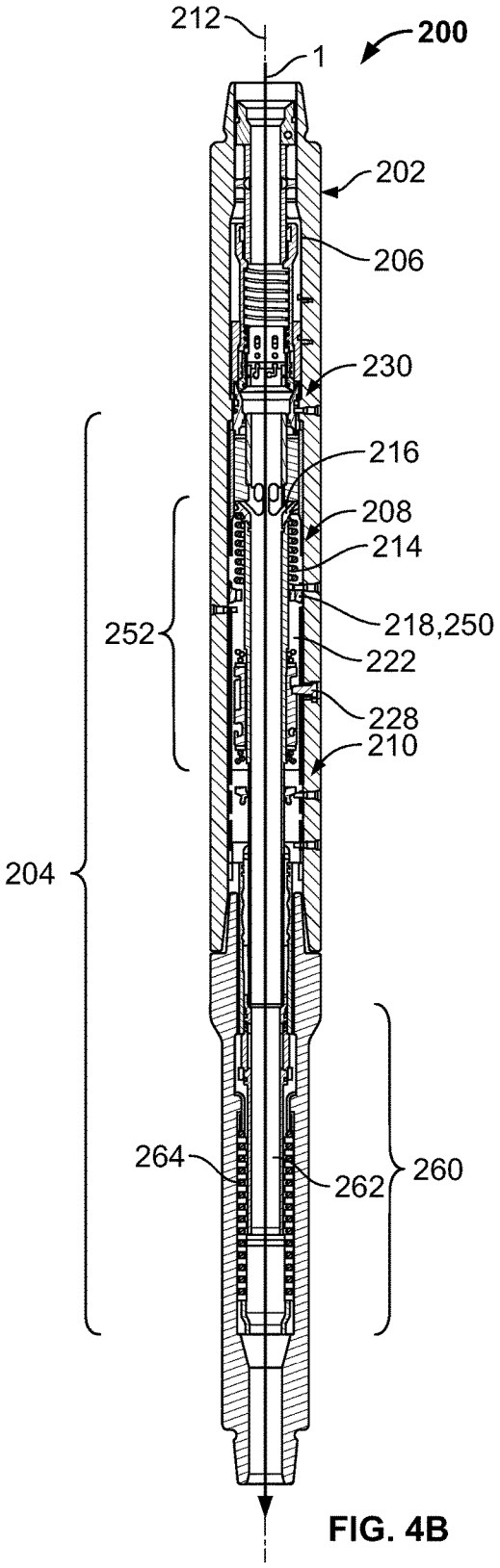
FIG. 4B is a cross-sectional side view of a bottom hole assembly featuring a second flow-diverter assembly in an open position.

FIGS. 4A and 4B are cross-sectional side views of a second example bottom hole assembly 200 that can, for example, be incorporated in the drilling rig 10 depicted in FIG. 1. The second example bottom hole assembly 200 is similar to the previous example, including an elongated housing 202 supporting various components of a first flow-diverter assembly 204 in its bore 206. The flow-diverter assembly 204 features a valve piston 208 and a barrel cam 210 arranged coaxially along a longitudinal axis 212 of the housing 202. The valve piston 208 and the barrel cam 210 cooperate to adjust a valve body 230 between an open condition and a closed condition as described above.

In this example, a flow restrictor 250 is employed to retard the downward motion of the valve piston 208 and the barrel cam 210. As shown, the flow restrictor 250 is located in control fluid chamber 252 defined by an annulus between an inner surface of the housing 202 and outer surfaces of various components of the flow-diverter assembly 204 (e.g., the outer surfaces of the valve piston 208 and the barrel cam 210). In particular, the flow restrictor 250 is incorporated in the flange 218 supporting the biasing member 214 of the valve piston 208. The control fluid chamber 252 is sealed from the flow of drilling fluid at the upper end by the sealing engagement between the valve piston's radial shoulder 216. The flow restrictor 250 separates the control fluid chamber 252 into adjacent compartments and constricts the flow of control fluid (e.g., oil) between the compartments as the valve piston 208 moves to create a dampening effect. As described below, the retarded movement of the valve piston 208 and the barrel cam 210 allows a locking system 260 to activate, preventing further downward motion and therefore "locking" the valve body 230 in its present open/closed condition.

In this example, the locking system 260 features a locking piston 262 oriented oppositely from the valve piston 208. Thus, the locking piston 262 is urged downward by a biasing member 264, and urged upward by hydraulic pressure forces created by the flow of drilling fluid 1. As shown in FIG. 4B, with the mud pumps 22 activated to create hydraulic pressure forces, the locking piston 262 moves upward to meet the distal end of the elongated coupler 222, engaging the coupler so as to prevent further downward motion of the valve piston 208 and the barrel cam 210. The biasing member 264 of the locking piston 262 provides a significantly increased spring force to be overcome by hydraulic pressure forces compared to the biasing member 114 of the valve piston 208. In other words, the valve piston 208 can be moved towards the lower position at mud-pump flow rates that are insufficient to move the locking piston 262 against the biasing member 264.

Figure 5A:
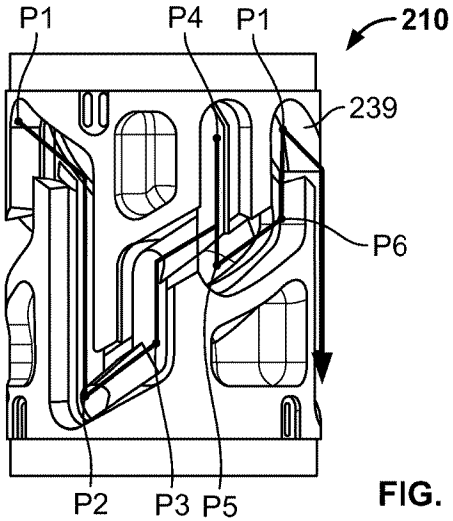
FIG. 5A is a side view of a barrel cam of the second flow-diverter assembly.

FIG. 5A is a side view of the barrel cam 210 illustrating the continuous track path created by the slot 239. The following description addresses six particular positions (P1-P6) occupied by the stationary pin 228 as the pin 228 traverses the track path. However, the present disclosure is not limited to the example discussed herein. That is, the system can be operated according to various other sequences that will be readily apparent to those of skill in the art.

Movement between positions P1 and P2 is substantially identical to the previous example, with the exception that this example involves an angled path that causes a slight rotation of the barrel cam 210 independent of the valve piston 208. As described above, with the stationary pin 228 at position P1, the valve body 230 is in an open condition because the valve piston 208 is in the lower position. To reach position Pl, the valve piston 208, together with the barrel cam 210, is moved downward by hydraulic force into the lower position due to high pressure in the housing's bore 206 caused by operating the mud pumps 22 at a high flow setting. At this point, the mud pumps 22 are deactivated (or merely adjusted to an appropriately lower flow setting), which causes a pressure decrease in the bore of the housing 202, allowing the biasing member 214 to pull the valve piston 208 across a full stroke to the upper position, which moves the barrel cam 210 correspondingly upwards relative to the stationary pin 228. This upward movement of the barrel cam 210 results in the stationary pin 228 moving to a lower position on the track path from position P1 to position P2. Thus, at position P2, the upper position of the valve piston 208, the valve body 230 is in a closed condition.

When the mud pumps 22 are reactivated to restore the high flow condition, the valve piston 208 is pushed downward. As the valve piston 208 bears on the barrel cam 210, the stationary pin 228 traverses the upward angled path of the slot 239 from position P2 to P3. The flow restrictor 250 retards the downward motion of the valve piston 208 and the barrel cam 210, which allows the locking piston 262 to move upward to engage the coupler 222 to suspend the barrel cam 210 and the valve piston 208 in place with the stationary pin 228 at position P3. Being suspended at position P3 of the barrel cam 210, the valve piston 208 is prevented from traversing a full stroke to the lower position. In this situation, the valve piston 208 is not moved downward enough to open the valve body 230; so the valve body 230 remains in the closed condition. With the locking piston 262 activated, cycling the mud pumps 22 OFF and ON at the high flow rate will cause the barrel cam 210 and valve piston 208 to cycle between positions P2 and P3 (as illustrated in the graph 240).

To advance passed position P3, the mud pumps 22 must be deactivated, disengaging the locking piston 262 from the coupler 222, and then reactivated at a predetermined index flow rate. The index flow rate creates sufficient hydraulic pressure forces to overcome the spring force of the valve piston's biasing member 214, but not the locking piston's biasing member 264. This condition allows the valve piston 208 and the barrel cam 210 to move downward across a full stroke to position P4, without encountering the locking piston 262 to place the valve body 230 in an open condition.

When the mud pumps 22 are again deactivated, the barrel cam 210 is pulled upward relative to the stationary pin 228, until the pin 228 arrives at position P5. Note that the path from position P4 to P5 is short of a full stroke for the valve piston 208, leaving the valve body 230 in an open position. When the mud pumps 22 are once again reactivated at a high flow setting, the barrel cam 210 is pushed downward by the valve piston 208 until the stationary pin 228 arrives at position P6 where further downward movement is prevented by the locking piston 262. Thus, the valve body 230 is now locked in the open position. With the locking piston 262 activated, cycling the mud pumps 22 OFF and ON at the high flow rate will cause the barrel cam 210 and valve piston 208 to cycle between positions P5 and P6 (as illustrated in the graph 240).

To advance passed position P6, the mud pumps 22 must be deactivated, disengaging the locking piston 262 from the coupler 222, and then reactivated at the predetermined index flow rate. This condition allows the valve piston 208 and the barrel cam 210 to move downward back to the lower position, without encountering the locking piston 262. The valve body 230 remains in the open position throughout the movement from P6 to Pl. However, at position P1 the valve body 230 is unlocked and can move freely to the closed condition at position P2.

Figure 5B:
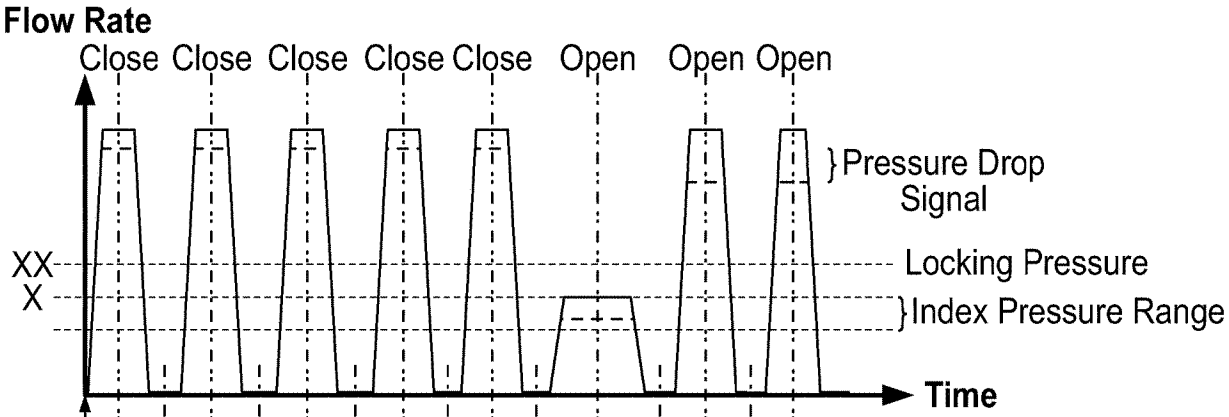
FIG. 5B is a graph illustrating a protocol for operating the second flow-diverter assembly.

FIG. 5B is a graph 240 illustrating a command protocol implemented by the controller 24 to operate the flow-diverter assembly 204 as described above with reference to FIG. 5A. In particular, the graph 240 illustrates how the controller 24 can cycle the mud pumps 22 from ON to OFF or from OFF to ON using a high flow rate (i.e., a flow rate that creates a hydraulic pressure force greater than the "locking pressure" required to activate the locking piston) without changing the condition of the valve body 230. This may be advantageous in situations where other components of the bottom hole assembly need to be periodically replaced, because the flow diverting characteristics of the system can be preserved throughout various starts and stops. The graph 240 also illustrates how the control 24 can cycle the mud pumps 22 from On to OFF and from OFF to ON using a predetermined index flow rate to change the condition of the valve body 230.

The use of terminology such as "upper," "lower," "above," and "below" throughout the specification and claims is for describing the relative positions of various components of the system and other elements described herein. Unless otherwise stated explicitly, the use of such terminology does not imply a particular position or orientation of the system or any other components relative to the direction of the Earth gravitational force, or the Earth ground surface, or other particular position or orientation that the system other elements may be placed in during operation, manufacturing, and transportation.

A number of embodiments of the invention have been described. Nevertheless, it will be understood that various modifications may be made without departing from the spirit and scope of the following claims.

What is claimed is:

1. A flow-diverter assembly positionable in a wellbore, comprising:

a housing having a circumferential sidewall, the circumferential sidewall defining an internal flow passage, the sidewall including a discharge port fluidly coupling the internal flow passage to a fluid flow path outside of the housing;

a valve piston located in the housing, said valve piston including a valve body in fluid communication with the internal flow passage, and said valve piston being movable axially along a longitudinal axis of the housing in response to pressure variations in the internal flow passage of the housing between an open position, where a vent of the valve body is fluidly coupled to the discharge port, and a closed position, where the vent of the valve body is substantially sealed from the discharge port;

a barrel cam rotatably mounted inside the housing, the barrel cam defining a circumferentially-arranged track path including axially-spaced first and second path locations corresponding to the open and closed positions of the valve piston;

a cam follower coupling the valve piston to the track path such that rotation of the cam displaces the valve piston between at least the open and closed positions of the valve piston; and a locking piston located within the housing and configured to prevent movement of the valve piston when the pressure within the internal flow passage of the housing is above a predetermined threshold, such that at an index pressure within the housing the valve piston actuates the valve piston and not the locking piston.

2. The flow-diverter assembly of claim 1, wherein the internal flow passage of the housing comprises a central passageway.

3. The flow-diverter assembly of claim 2, further comprising a pump fluidly coupled to the internal flow passage of the housing to provide a flow of drilling fluid therein while cycling between a low flow setting and a high flow setting to cause pressure variations inside the internal flow passage.

4. The flow-diverter assembly of claim 3, wherein the low flow setting comprises an off-condition of the pump.

5. The flow-diverter assembly of claim 1, further comprising a biasing member urging the valve piston towards the closed position.

6. The flow-diverter assembly of claim 1, wherein the cam follower comprises a stationary pin projecting radially inward from a surface of the surface of the housing.

7. The flow-diverter assembly of claim 1, wherein the valve piston and the barrel cam are located in a sealed control fluid chamber, and further comprising a flow restrictor located in the chamber between the valve piston and the barrel cam, the flow restrictor inhibiting a flow of control fluid in the chamber to create a dampening effect resisting movement of the valve piston.

8. The flow-diverter assembly of claim 1, wherein the locking piston a longitudinally movable locking piston.

9. The flow-diverter assembly of claim 8, wherein the locking piston includes a spring member providing more spring force than a biasing member of the valve piston, such that at the index pressure within the housing the valve piston actuates the valve piston and not the locking piston.

10. A method for controlling a flow of drilling fluid through a bottom hole assembly, the method comprising:

flowing drilling fluid through the bottom hole assembly, the bottom hole assembly including a flow-diverter sub-assembly including:

a housing having a circumferential sidewall, the circumferential sidewall defining an internal flow passage, the sidewall including a discharge port fluidly coupling the internal flow passage to a fluid flow path outside of the housing;

a valve piston located in the housing, said valve piston including a valve body in fluid communication with the internal flow passage, and said valve piston being movable axially along a longitudinal axis of the housing in response to pressure variations in the internal flow passage of the housing between an open position, where a vent of the valve body is fluidly coupled to the discharge port, and a second position, where the vent of the valve body is substantially sealed from the discharge port;

a barrel cam rotatably mounted inside the housing, the barrel cam defining a circumferentially-arranged track path including axially-spaced first and second path locations corresponding to the open and closed positions of the valve piston; and a cam follower coupling the valve piston to the track path such that rotation of the cam displaces the valve piston between at least the open and closed positions of the valve piston; and diverting an amount of the drilling fluid from the bottom hole assembly by increasing pressure within the internal flow passage beyond a minimum pressure to move the valve piston to the open position; and inhibiting downhole movement of the valve piston via a lock piston to lock the valve piston in a current position, and creating an index pressure within the internal flow passage to unlock the valve piston, wherein the magnitude of the index pressure is sufficient to move the valve piston and not the lock piston.

11. The method of claim 10, wherein the internal flow passage of the housing comprises a central passageway.

12. The method of claim 10, wherein the valve piston is urged towards the second position by a biasing member, and wherein the minimum pressure is a hydraulic pressure sufficient to overcome a resistance force of the biasing member.

13. The method of claim 10, further comprising determining a current position of the valve piston based on a hydraulic pressure measurement within the internal flow passage of the housing.

14. The method of claim 10, wherein flowing drilling fluid through the bottom hole assembly includes operating a pump to an on-condition, and wherein increasing pressure within the housing includes operating the pump to increase a current flow rate of the drilling fluid.

15. The method of claim 10, further comprising ceasing the diversion of drilling fluid from the bottom hole assembly by decreasing pressure within the housing to move the valve piston to the closed position.

16. The method of claim 10, wherein inhibiting downhole movement of the valve piston includes forcing a control fluid through a restrictor to dampen movement of the valve piston.

* * * * *